US011480047B2

(12) United States Patent
Courtwright et al.

(10) Patent No.: US 11,480,047 B2
(45) Date of Patent: Oct. 25, 2022

(54) SENSING A ROTATION SPEED AND ROTATION DIRECTION OF A MOTOR SHAFT IN AN ELECTRIC SUBMERSIBLE PUMP POSITIONED IN A WELLBORE OF A GEOLOGICAL FORMATION

(71) Applicant: Halliburton Energy Services, Inc., Houston, TX (US)

(72) Inventors: Tyler Clay Courtwright, Oklahoma City, OK (US); Ryan Bridwell Ashbaugh, Broken Arrow, OK (US); Dustin Campbell, Madison, AL (US); Carl Albert Palmgren, III, Eufaula, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 469 days.

(21) Appl. No.: 16/497,765

(22) PCT Filed: Dec. 28, 2018

(86) PCT No.: PCT/US2018/067851
§ 371 (c)(1),
(2) Date: Sep. 25, 2019

(87) PCT Pub. No.: WO2020/139368
PCT Pub. Date: Jul. 2, 2020

(65) Prior Publication Data
US 2021/0102456 A1 Apr. 8, 2021

(51) Int. Cl.
*E21B 47/008* (2012.01)
*E21B 43/12* (2006.01)
(Continued)

(52) U.S. Cl.
CPC ..... *E21B 47/008* (2020.05); *E21B 43/128* (2013.01); *F04D 13/10* (2013.01); *F04D 15/0066* (2013.01)

(58) Field of Classification Search
CPC ..... E21B 47/008; E21B 43/128
(Continued)

(56) References Cited

U.S. PATENT DOCUMENTS 6,343,415 B1 * 2/2002 Okuda ..... H05K 13/0413 29/721
8,115,428 B2 * 2/2012 Williams ..... B62D 5/064 318/400.34
(Continued)

OTHER PUBLICATIONS

PCT Application Serial No. PCT/US2018/067851, International Search Report, dated Sep. 25, 2019, 3 pages.
(Continued)

*Primary Examiner* — David Luo
(74) *Attorney, Agent, or Firm* — Delizio, Peacock, Lewin & Guerra

(57) ABSTRACT

One or more sensors are mounted on a collar proximate to a motor shaft of a motor. The motor is associated with an electric submersible pump (ESP) located in a wellbore of a geological formation. The one or more sensors sense one or more identifiers located on the motor shaft of the motor. One or more of a rotation direction and rotation speed of the motor shaft is determined based on the sensing of the one or more identifiers. The motor is powered to pump fluid from a reservoir in the geological formation to a surface of the geological formation based on the one or more of the rotation direction and rotation speed of the motor shaft.

19 Claims, 15 Drawing Sheets

(51) Int. Cl.
*F04D 13/10* (2006.01)
*F04D 15/00* (2006.01)

(58) Field of Classification Search
USPC ..... 318/490, 3
See application file for complete search history.

(56) References Cited

U.S. PATENT DOCUMENTS

| | | | | |
|---|---|---|---|---|
| 8,480,376 | B2 * | 7/2013 | Knox | E21B 47/008 318/644 |
| 9,777,723 | B2 * | 10/2017 | Wiegman | F04B 49/065 |
| 11,002,280 | B2 | 5/2021 | Esberger et al. | |
| 2010/0247335 | A1 | 9/2010 | Atherton | |
| 2011/0051297 | A1 | 3/2011 | Knox et al. | |
| 2012/0257995 | A1 | 10/2012 | True | |
| 2015/0152876 | A1 | 6/2015 | Chen et al. | |
| 2016/0265323 | A1 | 9/2016 | Rendusara et al. | |

OTHER PUBLICATIONS

PCT Application Serial No. PCT/US2018/067851, International Written Opinion, dated Sep. 25, 2019, 10 pages.
"EP Application No. 18945112.3, Extended Search Report", dated May 13, 2022, 8 pages.

* cited by examiner

Signals for Clockwise Shaft Rotation

Signals for Clockwise Shaft Rotation

Clockwise Rotation - A Leads B

| Shaft Position | Degrees | Sensor A Digital Logic State | Sensor B Digital Logic State |
|---|---|---|---|
| 1 | 0 | High | Low |
| 2 | 90 | High | High |
| 3 | 180 | Low | High |
| 4 | 270 | Low | Low |
| 1 | 0 | High | Low |

FIG. 3C

Signals for Counter-Clockwise Shaft Rotation

Signals for Counter-Clockwise Shaft Rotation

Counter Clockwise Rotation - B Leads A

| Shaft Position | Degrees | Sensor A Digital Logic State | Sensor B Digital Logic State |
|---|---|---|---|
| 3 | 180 | Low | High |
| 2 | 90 | High | High |
| 1 | 0 | High | Low |
| 4 | 270 | Low | Low |
| 3 | 180 | Low | High |

FIG. 4C

SENSING A ROTATION SPEED AND ROTATION DIRECTION OF A MOTOR SHAFT IN AN ELECTRIC SUBMERSIBLE PUMP POSITIONED IN A WELLBORE OF A GEOLOGICAL FORMATION

TECHNICAL FIELD

The disclosure generally relates to apparatus in the field of hydrocarbon production, and more particularly to sensing one or more of a rotation speed and rotation direction of a motor shaft in an electric submersible pump (ESP) positioned in a wellbore of a geological formation.

BACKGROUND ART

Various equipment is positioned in a wellbore of a geological formation to facilitate extraction of fluid within the geological formation to a surface of the geological formation. The fluid can be hydrocarbons, water, or other fluids. An electrical submersible pump, typically called an ESP, is an example of this equipment. The ESP is an efficient and reliable artificial-lift method for pumping moderate to high volumes of fluid. The ESP typically has an induction motor powered by a power supply that pumps the fluid from the reservoir to the surface via tubing installed in the wellbore. When the power supply is removed, it is possible for any fluid that remains in the tubing to drain back down into the reservoir. This frequently occurs in installations when there is no check valve installed in the tubing to prevent the fluid from draining back down or when the check valve leaks. As the fluid drains back down and passes through the ESP while not powered, the induction motor of the ESP rotates in a reverse direction, commonly referred to as "backspin." Backspin is a potentially dangerous condition that subjects field personnel working on the equipment to hazardous electrical shocks and/or electrocution.

BRIEF DESCRIPTION OF THE DRAWINGS

Embodiments of the disclosure may be better understood by referencing the accompanying drawings.

FIGS. 3A-C illustrate example analog signals output by sensors and associated digital logic states when a motor shaft rotates in a clockwise direction.

FIGS. 4A-C illustrate example analog signals output by sensors and associated digital logic states when a motor shaft rotates in a counter-clockwise direction.

Figure 1:
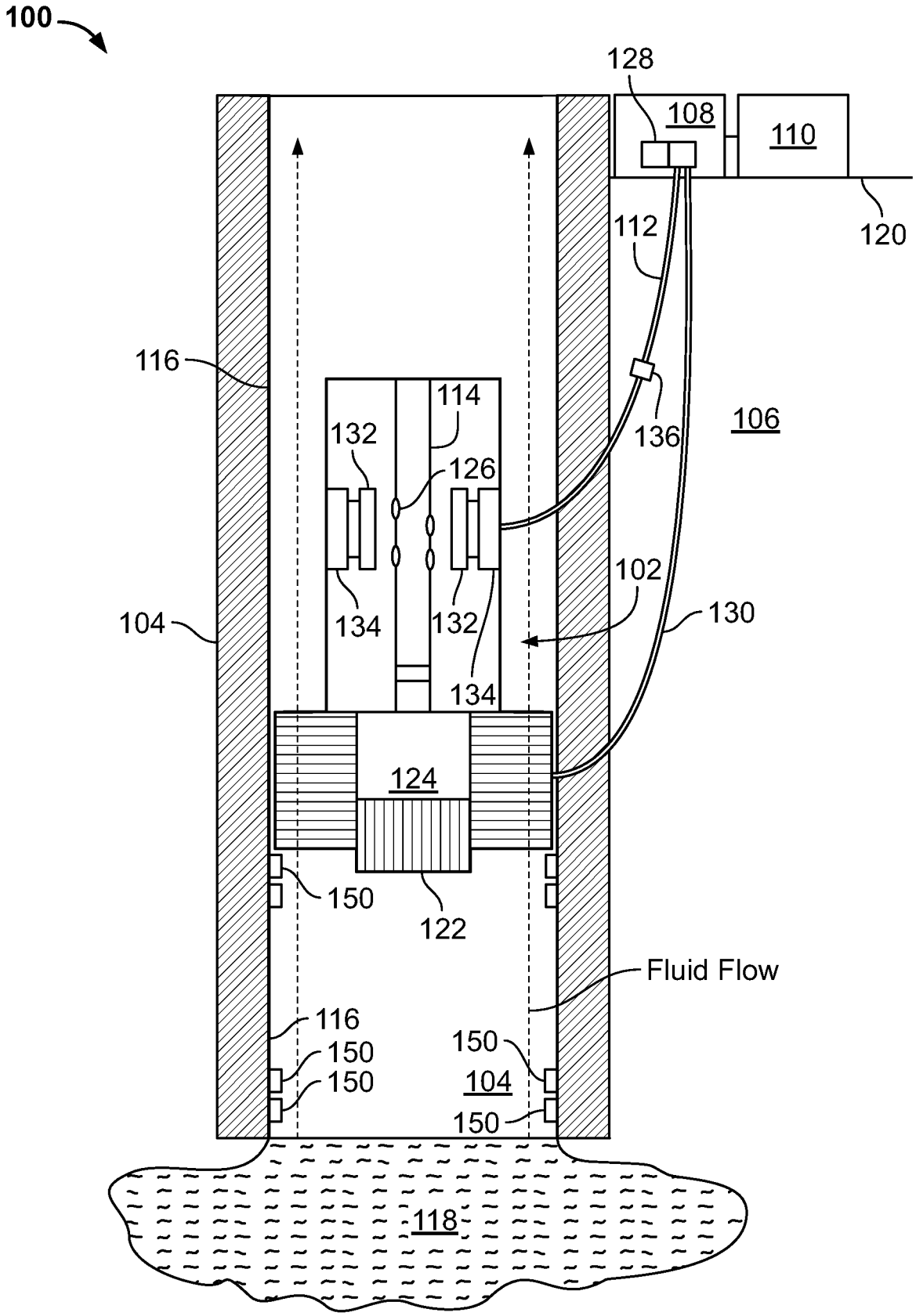
FIG. 1 illustrates a system for sensing one or more of a rotation speed and rotation direction of a motor shaft associated with a motor of an ESP positioned in a wellbore of a geological formation.

The drawings are for the purpose of illustrating example embodiments, but it is understood that the inventions are not limited to the arrangements and instrumentalities shown in the drawings.

DESCRIPTION OF EMBODIMENTS

The description that follows includes example systems, methods, techniques, and program flows that describe embodiments of the disclosure. However, it is understood that this disclosure may be practiced without these specific details. For instance, this disclosure refers to detecting rotation speed and rotation direction of a motor shaft in an electric submersible pump (ESP) located in a wellbore of a geological formation in illustrative examples. Embodiments of this disclosure can be instead applied to other rotating devices in other applications. In other instances, well-known instruction instances, protocols, structures and techniques have not been shown in detail in order not to obfuscate the description.

Overview

Attempting to start a motor of an electric submersible pump (ESP) located downhole in a geological formation while the motor is backspinning is discouraged. Application of power to the motor while the motor is backspinning can stress a motor shaft of the motor, potentially causing the ESP to fail. Also, the ESP is driven inefficiently because part of the applied power is used to counteract the backspin.

Starting the motor during backspin also poses a safety concern. A transformer applies power to the motor. Applying a voltage to the primary side of the transformer induces a voltage on the secondary side of the transformer. The motor connected to the secondary side of the transformer is then driven by the voltage on the secondary side. When power is not applied to the primary side and the motor is in backspin, the motor acts as a generator and generates high voltages. These high voltages applied to the secondary side of the transformer, and measurable on the primary side, poses a safety issue. The high voltage can injure well operators especially if the well operators are unaware that the motor is in backspin.

Embodiments described herein are directed to an alternative means for sensing one or more of a rotation speed of a motor shaft in an ESP positioned in a wellbore of a geological formation to improve efficiency and/or safety of the motor of the ESP. A motor shaft of the motor is arranged with one or more identifiers such as existing or specifically-created marks, cuts, holes, slots, splines, or embedded magnetics or magnetic material that create unique signatures that can be detected by a sensor in proximity to the motor shaft. The sensor may detect proximity to the identifier as the motor shaft rotates. For example, when a magnetic spline is closest to the sensor as the shaft rotates, the detected magnetic field might be strongest, while when a magnetic spline is farthest away from the sensor as the shaft rotates, the detected magnetic field might be weakest. Detection of the identifiers on the motor shaft by the sensors facilitates determining motor shaft rotation speed. The rotation speed can be used to determine whether the motor is rotating both when power is applied to the motor and also when the motor is in backspin, but without the safety concerns associated with prior art methods.

The sensor can take the form of a Hall effect sensor in one or more examples. The Hall effect sensor outputs an analog signal that varies in response to a magnetic field. For example, the analog signal is an output voltage proportional to a strength of the magnetic field. The sensor can take other forms including a coil of wire such as aluminum or copper wound around a nonmagnetic core, or inductive proximity. A frequency of the analog signal or associated digital logic states indicates the rotation speed of the motor shaft. A determination can be made whether power should be applied to the motor based on the frequency. For example, when the frequency is below a threshold level, then power may be applied to the motor because the rotation speed is slow enough that starting the motor will not cause excessive stress on the motor shaft even if the motor is in backspin. Also, significant power is not used to counteract the backspin. Alternatively, when the frequency is greater than a threshold level, then power should not be applied to the motor because the rotation speed is fast enough that starting the motor induces excessive stress on the motor shaft even if the motor is in backspin. Also, significant power is wasted to counteract the backspin.

Embodiments described herein are also directed to sensing the rotational direction of the motor shaft in the ESP. The rotation direction indicates whether the motor is in backspin. Two or more sensors are positioned around the motor shaft of the motor at different azimuths. Each of the two or more sensors is arranged to detect proximity to an identifier on the motor shaft as the motor shaft rotates and output an analog signal and/or digital logic states that indicates proximity. The direction of rotation depends on relative phase differences of the analog signals and/or relative phase differences of the digital logic states. For example, if a rising edge associated with a sensor located at 0 degrees azimuth leads a rising edge associated with a sensor located at 90 degrees azimuth, then the motor is rotating in one direction, while if a rising edge associated with a sensor located at 0 degrees azimuth lags a rising edge associated with a sensor located at 90 degrees azimuth, then the motor is rotating in the opposite direction. Alternatively, the motor shaft of the motor is arranged with a single sensor and two or more unique identifiers positioned at different azimuths on the motor shaft. The single sensor uniquely detects the two or more identifiers positioned on the motor shaft. For example, if the sensor outputs a pulse indicating detection of the identifier at 0 degrees azimuth having a strong magnetic field followed by a pulse indicating detection of the identifier at 90 degrees azimuth having a weaker magnetic field, then the motor shaft is rotating in one direction. If the sensor outputs a pulse indicating detection of the identifier at 90 degrees azimuth having a strong magnetic field followed by a pulse indicating detection of the identifier at 0 degrees azimuth having a weaker magnetic field, then the motor shaft is rotating in the opposite direction. The direction of rotation indicates whether the motor is in backspin. In this regard, power may be applied to the motor if the motor is not in backspin and power is not applied to the motor if the motor is in backspin.

Knowledge of one or more of a rotation speed and/or rotation direction of a motor in backspin potentially reduces stress on the motor shaft of the motor by properly controlling power applied to the motor. Power is applied to the motor when the motor is not in backspin and/or the rotation speed is below a threshold amount. The reduction in stress reduces potential downtime of the ESP due to motor failure. Also, counteracting backspin does not consume significant power. Accurate determination of the rotation speed and/or rotation direction of the motor also facilitates accurate calculation of fluid pumped by the motor. An amount of fluid pumped by the motor at different speeds is known, for example, during a calibration and/or testing process of the motor. Based on the rotation speed and/or the rotation direction of the motor, a determination can be made as to the fluid pumped by the motor so as to accurately control the pumping process.

The description that follows includes example systems, apparatuses, and methods that embody aspects of the disclosure. However, it is understood that this disclosure may be practiced without these specific details. In other instances, well-known instruction instances, structures and techniques have not been shown in detail in order not to obfuscate the description.

Example Illustrations

FIG. 1 illustrates a system 100 that comprises an electrically submersible pump (ESP) 102 positioned in a wellbore 104 of a geological formation 106, a power source 108 to power the ESP 102, a computer system 110 coupled to the power source 108, and a data communication path 112. The system 100 facilitates sensing one or more of a rotation speed and rotation direction of a motor shaft 114 of the ESP 102 and conveying information indicating the rotation speed and/or rotation direction of the motor shaft 114 between the ESP 102 and the computer system 110 via the data communication path 112.

The ESP 102 lifts moderate to high volumes of fluids from the wellbore 104. The fluids may be pumped via a fluid column such as tubing 116 that spans between a reservoir 118 and a surface 120. The tubing 116 may have one or more perforations 150 that allows fluid, such as hydrocarbons, in the reservoir 118 to flow into the tubing 116. In turn, the ESP 102 may pump the fluid, such as hydrocarbons, that flows into the tubing 116 to the surface 120.

The ESP 102 may have a motor base 122 on which a motor 124 and the motor shaft 114 are mounted. The motor 124 may take the form of an induction motor that rotates the motor shaft 114. The motor shaft 114 is, in turn, coupled to a pump impeller (not shown) such that rotation of the motor shaft 114 causes the ESP 102 to generate artificial lift which pumps the fluid, such as hydrocarbons, from a reservoir 118 in the geological formation 106 to the surface 120. The motor shaft 114 may be made of steel or some other material. The motor shaft 114 may have one or more identifiers 126 that facilitates detection of one or more of a rotation speed and rotation direction of the motor shaft 114. The identifiers 126 may be existing or specifically-created marks, cuts, holes, slots, splines, or embedded magnetics or magnetic material in or on the motor shaft 114. The identifiers 126 may be machined, formed, and/or attached to the motor shaft 114.

The motor 124 of the ESP 102 may be powered via the power source 108 that is located at the surface 120 of the geological formation 106 or downhole. The power source 108 may be arranged in a wye configuration and output one or more voltage signals having different relative phases. For example, each voltage signal may be separated by a given phase angle such as 120 degrees. The one or more voltage signals may be input into a transformer 128 having a primary side and a secondary side. A turns ratio between the primary and secondary side may be 4:1. The turns ratio results in a voltage signal at 480 volts AC inducing a voltage of 1920 volts AC on the secondary side of the transformer. The higher voltage allows for efficient transfer of the power downhole at a lower current via a powerline 130 to the motor 124 and inducing a magnetic field on a stator winding in the motor 124 which in turn produces torque on the motor shaft 114 causing the motor 124 to rotate in a specific direction.

The ESP 102 may have a sensor 132 to sense the identifiers 126 as the motor shaft 114 rotates. The sensor 132 may be mounted around the motor shaft 114. The sensor 132 is shown mounted on the collar 134 or shaft guard positioned around the motor shaft 114, but could also be mounted on the motor base 122. The sensor may detect proximity to the identifier as the motor shaft rotates. In one or more examples, the identifier 126 may take the form of a magnetic spline and the sensor 132 may take the form of a Hall effect sensor. The Hall effect sensor outputs an analog signal that varies in response to a magnetic field. When the magnetic spline is closest to the sensor 132 as the motor shaft 114 rotates, the detected magnetic field is strong, while when the magnetic spline is farthest away from the sensor 132 as the motor shaft 114 rotates, the detected magnetic field is weak. The analog signal output by the Hall effect sensor may be proportional to a strength of the magnetic field. The sensor 132 can take other forms including a coil of wire such as aluminum or copper wound around a nonmagnetic core, or inductive proximity magnetic field. If the identifier includes cuts, holes, slots, splines without magnetic properties, then sensor 132 may take the form of optical sensors. The optical sensor may detect presence of the identifier in a field of view of the optical sensor as the motor shaft rotates and provide an indication that the identifier is detected. For example, the optical sensor may output a pulse when the identifier is in the field of view of the optical sensor.

The sensor 132 may be associated with sensor circuitry such as analog hardware, digital hardware, and/or software to determine one or more of shaft position, rotation speed and rotation direction of the motor shaft 114 based on an output of the sensor 132. In one or more examples, the sensor circuitry may be integrated with the sensor 132 or separate in the ESP. In one or more examples, the sensor circuitry may be coupled to a downhole gauge 136. The downhole gauge 136 may receive data indicating the shaft position, rotation speed and/or rotation direction of the motor shaft 114 from the sensor circuitry and modulate a DC signal in voltage and/or current indicating the shaft position, speed, and direction of rotation of the motor 124 to convey the data to the surface 120 via the data communication path 112. One end of the data communication path 112 may terminate at the downhole gauge 136. The other end of the data communication path 112 may be a tap off a center of the wye configuration in the power source 108. In this regard, the data communication path 112 may carry the DC signal that is then modulated.

The computer system 110 may receive data indicating rotation speed and rotation direction of the motor shaft 114 from the power source 108 to make a determination as to whether to power the motor 124 and/or to calculate how much fluid is pumped by the ESP 102. The determination of when to power the motor 124 may be important because when the motor is powered off, there may be fluid remaining in the tubing 116 that does not reach the surface 120. This fluid may flow back down into the reservoir 118 and cause the pump impeller to rotate and in turn cause the motor shaft 114 and the motor 124 to rotate in a direction opposite to which it would spin if the fluid is pumped to the surface 120. The computer system 110 may not apply power to the motor 124 if the motor shaft 114 is rotating in a direction indicating that fluid is flowing down the tubing 116 into the reservoir 118 because application of power to the motor 124 will cause the motor 124 to rotate in an opposite direction, applying excessive stress on the motor shaft 114. Further, power would be consumed to rotate the motor 124 in the opposite direction to counteract the downward flowing fluid resulting in the motor 124 not rotating as fast and/or rotating inefficiently. Alternatively, the computer system 110 may control power applied to the motor 124 if data indicates that the motor 124 is not rotating or if the motor 124 is rotating in a direction indicating that fluid is flowing up the tubing 116. As yet another example, the computer system 110 may control power applied to the motor 124 if the motor 124 is rotating in backspin at less than a given speed because stress on the motor shaft 114 may be minimal. In this regard, the rotation speed and/or rotation direction may be used to determine whether the motor 124 is in backspin and to apply power to the motor 124 when risk of stress on the motor shaft 114 and/or inefficiency is low.

Determination of rotation speed and/or rotation direction is also important to control the fluid pumping from the reservoir 118 in the geological formation 106 to the surface 120 when the motor 124 is powered on. The rotation speed and/or rotation direction facilitates accurate calculation of fluid pumped by the motor 124. An amount of fluid pumped by the motor 124 at a given rotation speed may be known. For example, the motor 124 may pump a given volume of fluid per revolution of the motor 124 when the motor 124 rotates in a given direction. Based on the speed of the motor 124 and/or the direction in which the motor 124 is rotating, a determination can be made as to the quantity of fluid pumped by the motor 124 so as to accurately control fluid production from the reservoir 118.

Figure 2:
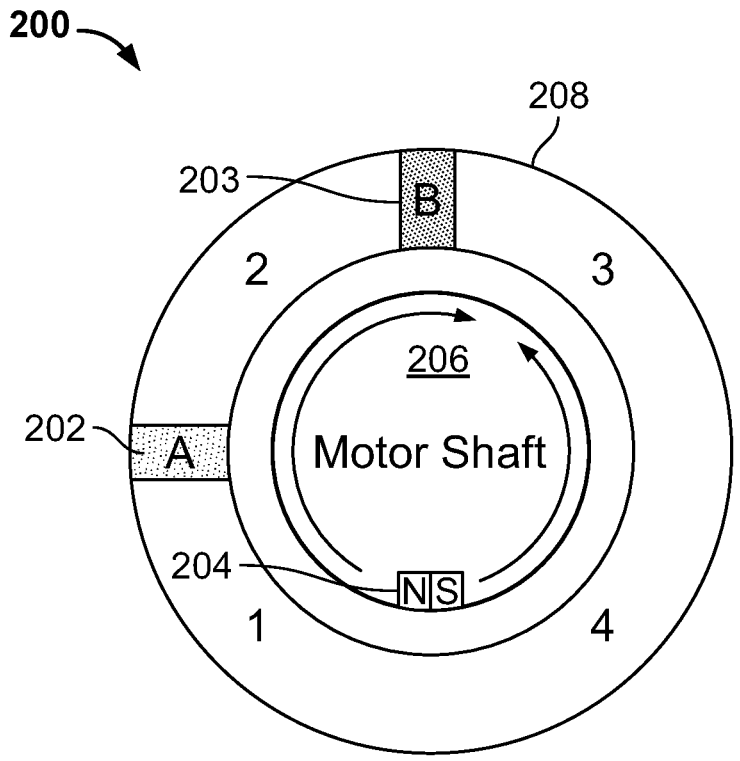
FIG. 2 illustrates an example of the sensing apparatus.

FIG. 2 illustrates an example cross-sectional view 200 of sensor A 202, sensor B 203, identifier 204, and motor shaft 206 in the ESP for determining a rotation speed and/or rotation direction of motor shaft 206. Two sensors, sensor A 202 and sensor B 203 may be arranged proximate to motor shaft 206 on a collar 208 or some other mounting location at two different azimuths around motor shaft 206. Various azimuths around the motor shaft are labeled as shaft positions 1 to 4. Motor shaft 206 may have identifier 204. Sensor A 202 or sensor B 203 may detect its proximity to the identifier 204 as the motor shaft 206 rotates. For example, when a spline having magnetic properties is closest to sensor A 202 or sensor B 203 the magnetic field may be strongest. As another example, when the spline having magnetic properties is farthest away from sensor A 202 or sensor B 203, the magnetic field may be weakest. Detection of the magnetic field and/or change in magnetic field by sensor A 202 and/or by sensor B 203 indicates that motor shaft 206 is rotating and also indicates one or more of a rotational speed of motor shaft 206 and rotation direction (e.g., clockwise or counter-clockwise) of motor shaft 206.

Figure 3A:
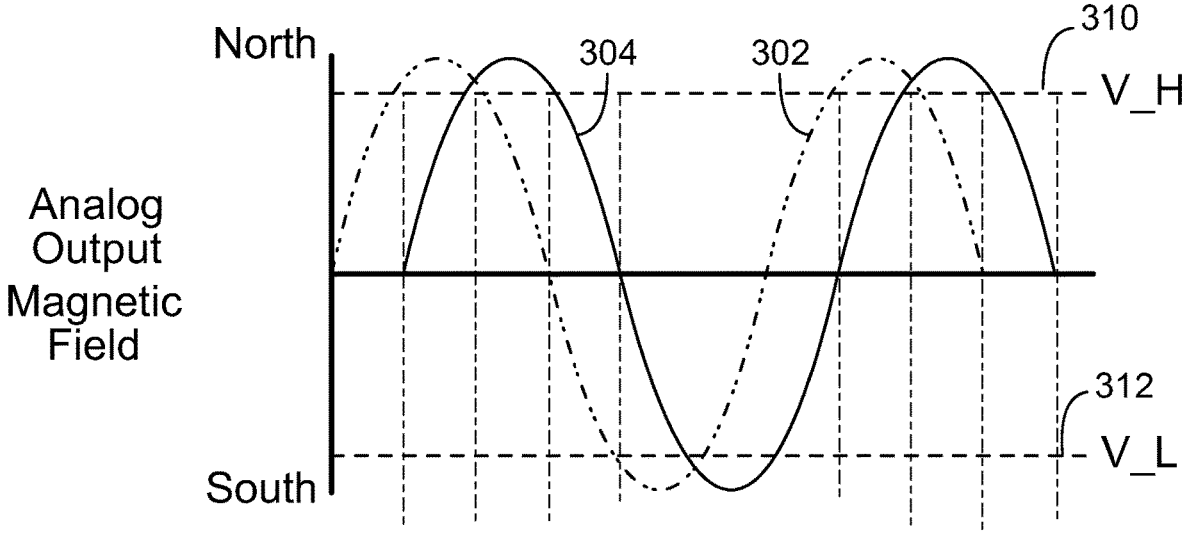

FIG. 3A is an example of an analog signal 302 output by sensor A 202 and analog signal 304 output by sensor B 203 in the form of Hall effect sensors and its corresponding digital representation 306 and 308 when the motor shaft 206 rotates in a clockwise direction. The analog signals 302, 304 may alternate between a positive signal level and negative signal level as the north and south poles of the identifier 204 are sensed. When the north pole of the identifier 204 is near a sensor, an amplitude of the analog signal output 302 or 304 may be at a peak while when the south pole of the identifier 204 is near a sensor, an amplitude of the analog signal output 302 or 304 may be at a valley. As another example, when the identifier 204 is away from a sensor, an amplitude of the analog signal may be close to zero. The analog signal 302, 304 may take other forms as well depending on proximity to the identifier 204.

Figure 3B:
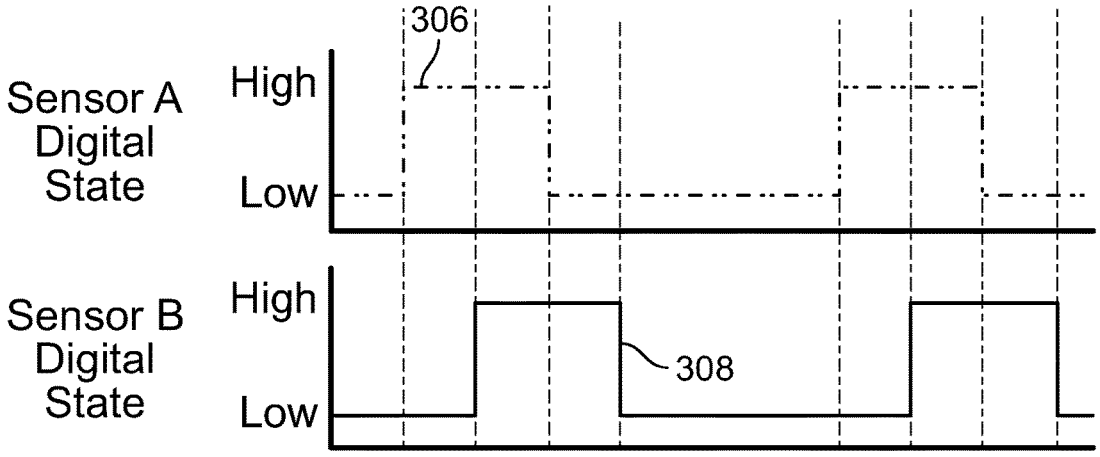

FIG. 3B is an example of sensor A digital logic states 306 associated with the analog signal 302 output from sensor A 202 and sensor B digital logic states 308 associated with the analog signal 304 output from sensor B 203 when the motor shaft 206 rotates in a clockwise direction. The analog signal (e.g., voltage signal) having a value above a threshold voltage level V_H 310 may indicate that one or more magnetic features (e.g., north pole of a magnet) on the rotating motor shaft 206 is in close proximity to one or more of sensor A 202 or sensor B 203, while the analog signal having a value below a threshold voltage level V_L 312 may indicate that one or more magnetic features (e.g., south pole of a magnet) on the rotating motor shaft 206 is in close proximity to sensor A 202 or sensor B 203. The analog signal is converted to digital logic states by comparing an amplitude of the analog signal to the threshold voltage level V_H 310. If an amplitude of the analog signal associated with sensor A 202 or sensor B 203 is above the threshold voltage level V_H 310, then a digital logic state may be a logical 'high' level until the amplitude falls below zero at which time the digital logic state is a logical 'low' level. The digital logic state may transition to the logical 'low' level state by crossing other thresholds such as threshold voltage level V_L 312. Based on the sensor A digital logic states 306 and sensor B digital logic states 308 at a time instant, an angular position (e.g., azimuth) of motor shaft 206 can be estimated.

FIG. 3C shows that sensor A digital logic states 306 and sensor B digital logic states 308 indicates an angular position of the identifier 204 with respect to sensor A 202 and sensor B 203. For example, if a sensor A digital logic state 306 is logical 'high' and the sensor B digital logic state 308 is logical 'low' concurrently, then the identifier 204 may be at 0 degrees shown as shaft position 1 in FIG. 2. As another example, if the sensor A digital logic state 306 is logical 'high' and sensor B digital logic state 308 is logical 'high' concurrently, then the identifier 204 may be at 90 degrees shown as shaft position 2 in FIG. 2. As yet another example, if the sensor A digital logic state 306 is logical 'low' and the sensor B digital logic state 308 is logical 'high' concurrently, then the identifier 204 may be at 180 degrees shown as shaft position 3 in FIG. 2. For example, if the sensor A digital logic state 306 is logical 'low' and the sensor B digital logic state 308 is logical 'low' concurrently, then the identifier 204 may be at 270 degrees shown as shaft position 4 in FIG. 2.

Figure 4A:
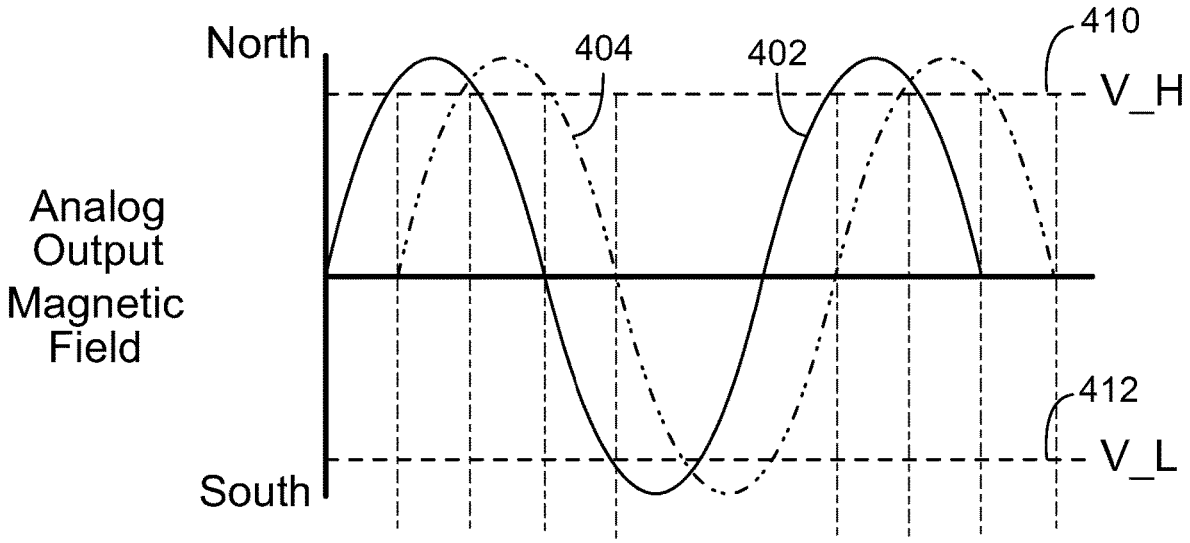

FIG. 4A is an example of an analog signal 402 output by sensor B 203 and analog signal 404 output by sensor A 202 when the motor shaft 206 rotates in a counter-clockwise direction. The analog signals 402, 404 may alternate between a positive signal level and negative signal level as the north and south poles of the identifier 204 are sensed. When the north pole of the identifier 204 is near a sensor, an amplitude of the analog signal output 402 or 404 may be at a peak while when the south pole of the identifier 204 is near a sensor, an amplitude of the analog signal output 402 or 404 may be at a valley. As another example, when the identifier 204 is away from a sensor, an amplitude of the analog signal may be close to zero. The analog signal 402, 404 may take other forms as well, depending on proximity to the identifier 204.

Figure 4B:
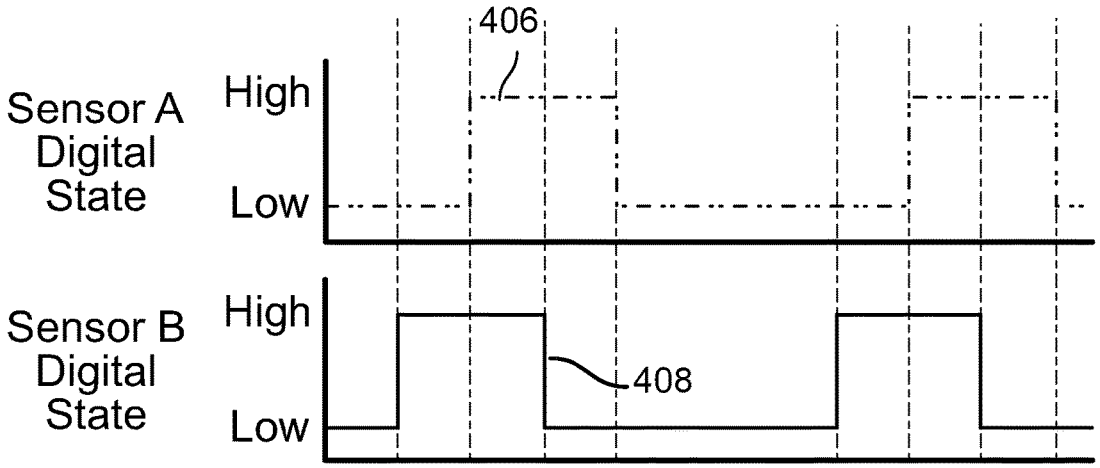

FIG. 4B is an example of sensor A digital logic states 406 associated with the analog signal 404 output from sensor A 202 and sensor B digital logic states 408 associated with the analog signal 402 output from sensor B 203 when the motor shaft 206 rotates in a counter-clockwise direction. The analog signal 402 and analog signal 404 are converted to the digital logic states 406, 408 by comparing an amplitude of the analog signal to a threshold voltage level V-H 410 and zero in a manner similar to that described with respect to FIG. 3B. Based on the sensor A digital logic states 406 and sensor B digital logic states 408 at a time instant, an angular position of motor shaft 206 can be estimated.

FIG. 4C shows that sensor A digital logic states 406 and sensor B digital logic states 408 indicate an angular position of the identifier 204 with respect to sensor A 202 and sensor B 203. For example, if the sensor A digital logic state 406 is logical 'high' and the sensor B digital logic state 408 is logical 'low' concurrently, then the identifier 204 may be at 0 degrees shown as shaft position 1. As another example, if the sensor A digital logic states 406 is logical 'high' and the sensor B digital logic state 408 is logical 'high' concurrently, then motor shaft identifier 204 may be at 90 degrees shown as motor shaft position 2. As yet another example, if the sensor A digital logic state 406 is logical 'low' and the sensor B digital logic state 408 is logical 'high' concurrently, then the identifier 204 may be at 180 degrees shown as motor shaft position 3. For example, if the sensor A digital logic state is 'low' and the sensor B digital logic state 408 is logical 'low' concurrently, then the identifier 204 may be at 270 degrees shown as motor shaft position 4.

Figure 5:
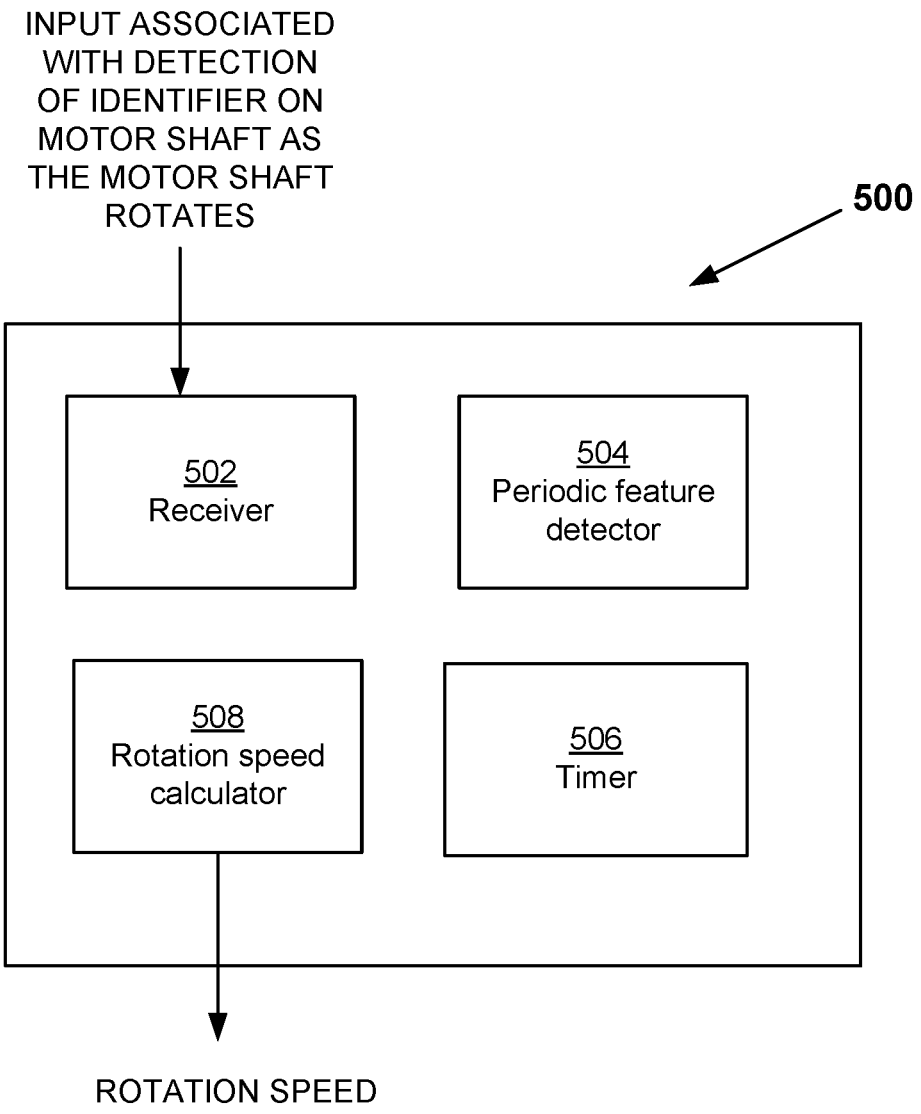
FIG. 5 is a block diagram of components for determining rotation speed of the motor shaft.

FIG. 5 is a block diagram 500 that illustrates example components for determining rotation speed of motor shaft 206. The components may be part of the sensor circuitry, computer system, and/or a combination of both the sensor circuitry and the computer system. The block diagram 500 for determining the rotation speed includes a receiver 502, a periodic feature detector 504, a timer 506, and speed calculator 508. Elements of block diagram 500 can be implemented in hardware, in software, or in combinations thereof. The input into receiver 502 may be the analog signal or digital logic states associated with one or more of sensor A 202 or sensor B 203, and the output of rotation speed calculator 508 may be the rotation speed of motor shaft 206.

Figure 6:
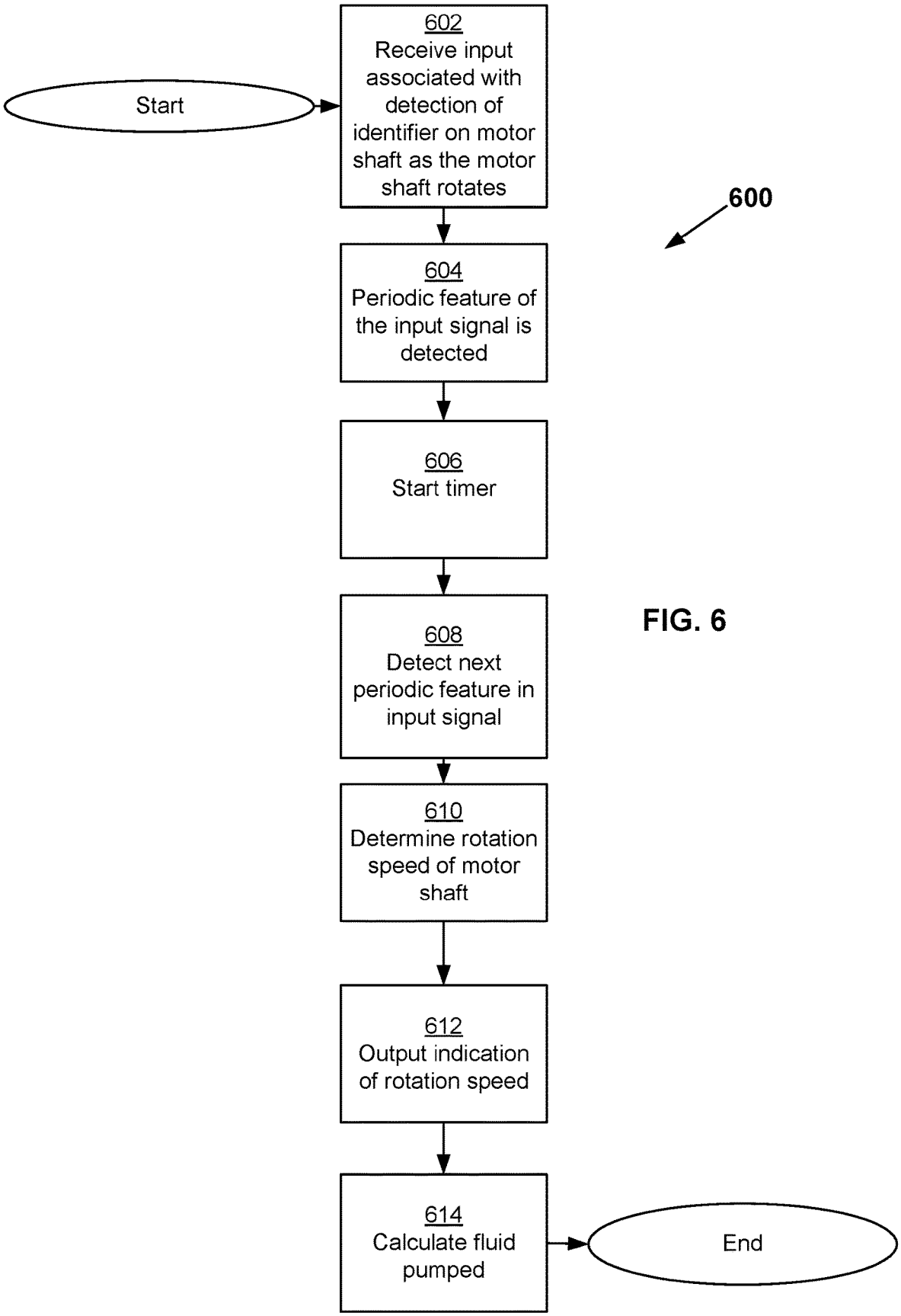
FIG. 6 is a flow chart of functions associated with determining rotation speed of the motor shaft.

FIG. 6 is a flow chart 600 of functions associated with determining the motor shaft rotation speed in accordance with the block diagram of FIG. 5. The functions may be implemented in hardware, in software, or in a combination of both hardware and software.

At 602, the determination of the rotation speed of motor shaft 206 may begin with the receiver 502 receiving an input associated with detection of an identifier 204 on motor shaft 206. The input may be the analog signal from a sensor, digital logic states, or some other signal.

At 604, a periodic feature of the input signal is detected, e.g., by the periodic feature detector 504. The periodic feature may take a variety of forms. For example, the periodic feature may be a rising edge of the analog signal crossing zero or rising edge of a digital logic state. As another example, the periodic feature may be a falling edge of the analog signal crossing zero or falling edge of a digital logic state. As yet another example, the periodic feature may be detecting a peak or valley of the analog signal, or an amplitude of the analog signal being some percentage of a full scale value (e.g., 10%, 50%, 90% of a full scale value such as V_H 310, 410 or V_L 312, 412). The periodic feature may be sensed using the periodic feature detector 504. If the periodic feature is the peak, then the periodic feature detector 504 detects whether an amplitude of the analog signal is above a threshold level V_H 410. If the amplitude is above the threshold level such as threshold level V_H 410, then a peak is sensed. If the amplitude does not exceed the threshold amount such as threshold level V_H 410, then a peak is not sensed. If the periodic feature is the valley, then the periodic detector 504 detects if the amplitude drops below the threshold level such as threshold level V_L 412. If the amplitude is below the threshold level such as threshold level V_L 412, then a valley is sensed. If the amplitude remains above the threshold level such as threshold level V_L 412, then a valley is not sensed. If the periodic feature is a rising or falling edge crossing zero, the periodic detector 504 may detect a slope of the analog signal and a voltage level of the analog signal to detect the rising or falling edge crossing zero. If the periodic feature is a rising or falling edge of a digital state, the periodic detector 504 may detect a positive or negative transition in the digital logic states to detect the rising or falling edge.

At 606, a timer 506 is started to measure a time between successive periodic features. The timer 506 may measure elapsed time detecting one instance of the periodic feature to another instance of the periodic feature.

At 608, the periodic feature of the output signal is detected again, e.g., by the periodic feature detector 504.

At 610, a rotation speed of the motor shaft 206 is determined by the rotation speed calculator 508 based on the time between successive periodic features. In one or more examples, the rotation speed may be a frequency of detected periodic features. The frequency indicates a speed in which the motor is spinning, e.g., a periodicity. For example, a short duration (high frequency) between successive peaks, valleys, rising edges, falling edges, may indicate that shaft 206 is spinning quickly while a long duration (low frequency) may indicate that shaft 206 is spinning slowly. An alternate example may be a revolution per minute (RPM) value or some other indicator of speed of rotation determined based on counting a number of the periodic feature detected over a period of time and dividing the count by the period of time.

At 612, an indication of the rotation speed is output. For example, the indication of rotation speed may be output to the downhole gauge which in turn sends the indication to the computer system.

At 614 the rotation speed of the motor may be used by the computer system to calculate an amount of fluid being pumped by the ESP. Each revolution of the motor may correspond to a given amount of fluid being pumped by the ESP. In this regard, the rotation speed of the motor shaft 206 may indicate an amount of fluid pumped over a period of time.

Figure 7:
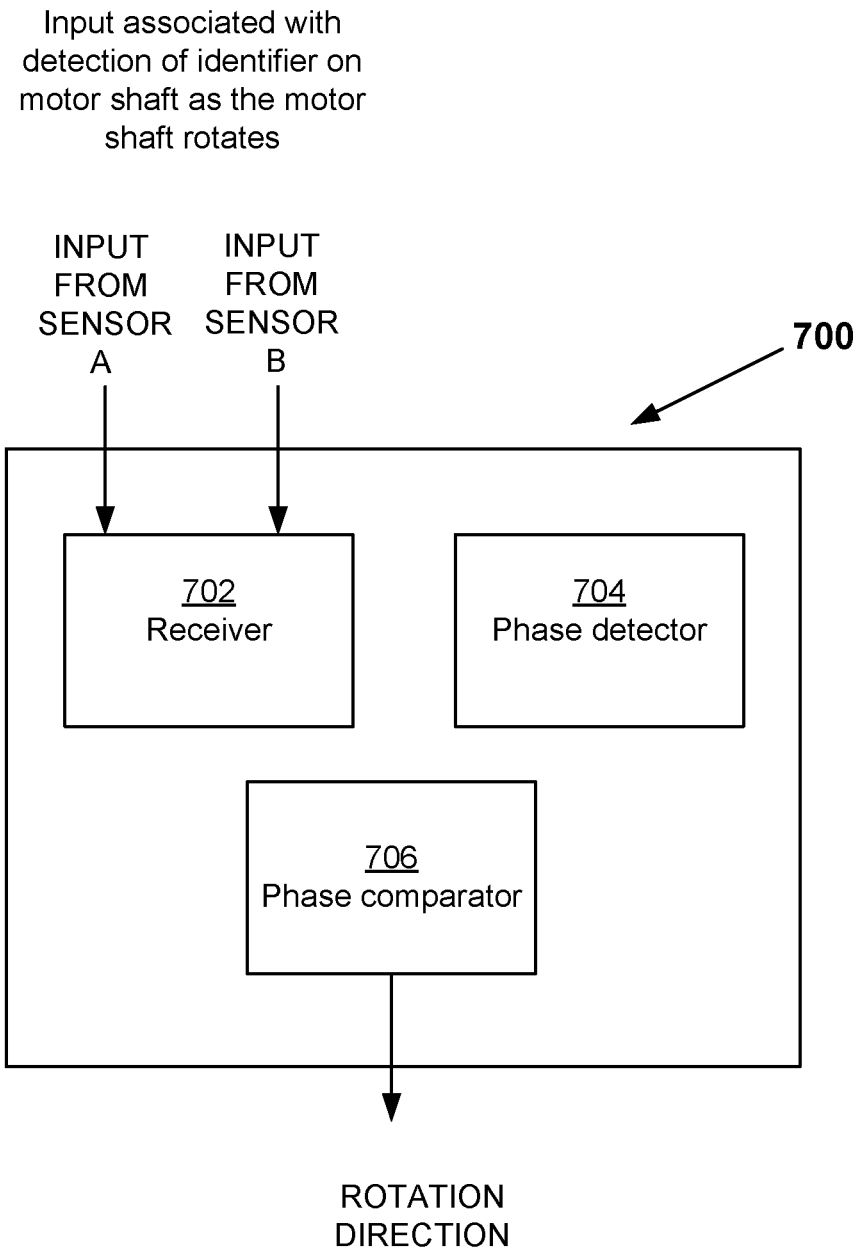
FIG. 7 is a block diagram of components for determining the rotation direction of the motor shaft based on relative phase detection.

FIG. 7 is a block diagram 700 that illustrates functions for determining the rotation direction of the motor based on phase detection of sensor A signal and sensor B signal. Sensor A signal and sensor B signal may take the form of the analog signal and/or corresponding digital logic states. Elements of the block diagram 700 can be implemented in hardware, in software, or in combinations thereof. The components may be part of the sensor circuitry, computer system, and/or combination of both the sensor circuitry and computer system. The block diagram 700 for determining the rotation direction includes a receiver 702, phase detector 704, and phase comparator 706. The sensor A signal and sensor B signal may be input into the receiver 702 and the phase comparator 706 may provide an output indicating a rotation direction of the motor shaft 206.

Figure 8:
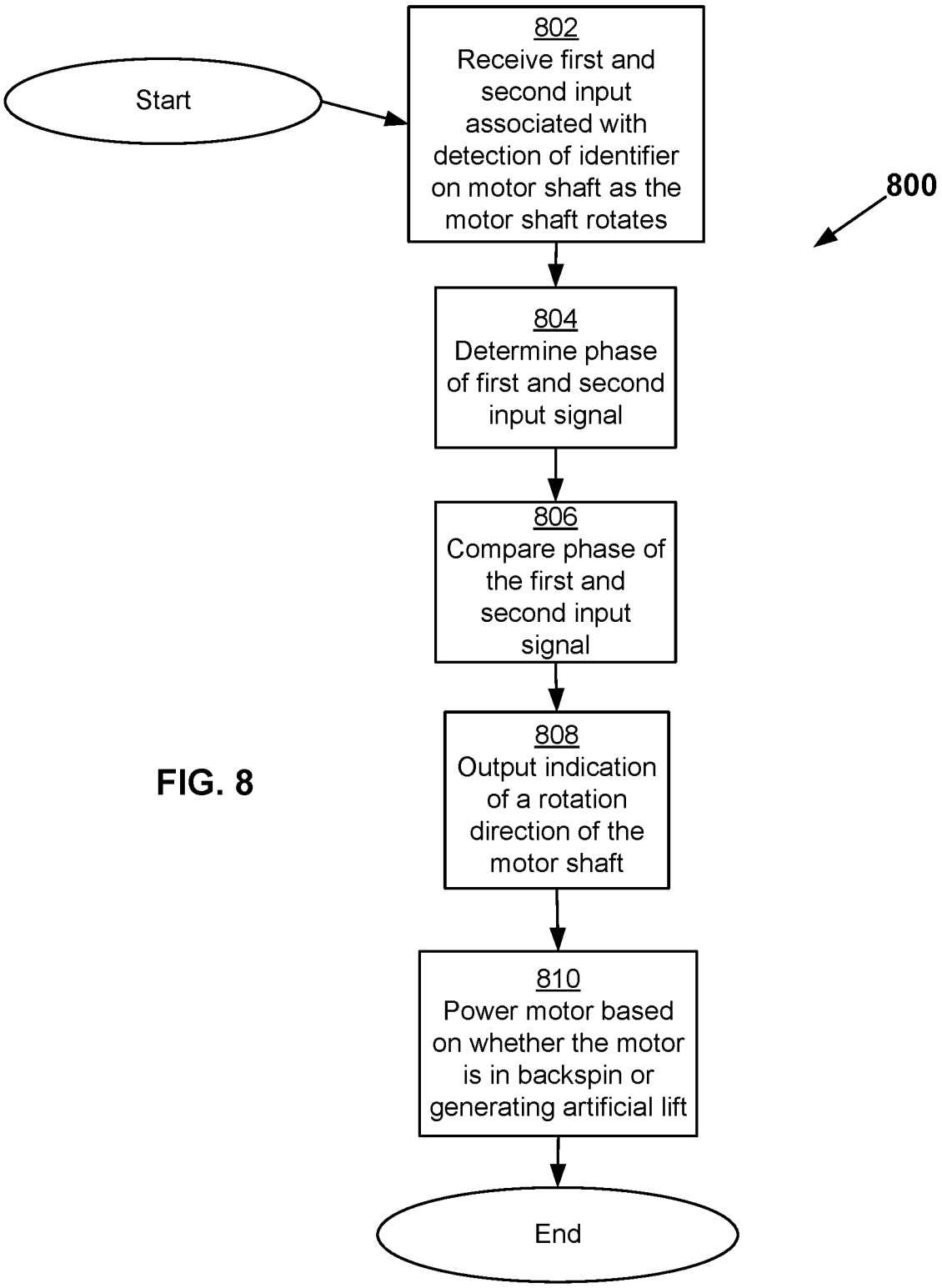
FIG. 8 is a flow chart of functions associated with determining rotation direction of the motor shaft based on relative phase detection.

FIG. 8 is a flow chart of functions 800 describing the process to determine the rotation direction of the motor shaft based on phase detection. The rotation direction, which may be a clockwise direction or counter-clockwise direction, may be based on respective input signals associated with the two sensors. The input signals may be respective analog signals output by the two sensors. Additionally, or alternatively, the input signals may be respective digital logic states associated with the two sensors.

At 802, a first input and a second input are received by a receiver 702 from respective sensors as the motor shaft rotates. The first input may indicate sensing of the identifier 204 on the motor shaft 206 by a first sensor and the second input may indicate sensing of the identifier 204 on motor shaft 206 by a second sensor as the motor shaft 206 rotates.

At 804, a phase of the first input signal and a phase of the second input signal is determined by the phase detector 704.

At 806, a phase of the first input signal and a phase of the second input signal are compared by the phase comparator 706. The comparison results in a phase difference that indicates rotation direction of the motor shaft 206. Determining rotation direction depends upon a phase angle differences of two or more signals measured against each other. Determining phase angle difference may involve measuring a reference point in a signal against a second point within a single cycle of the same signal or measuring a reference point in one signal against a point in a second signal that occurs within a single cycle of the first signal. For example, if the rising edge of the input signal associated with sensor A leads the rising edge of sensor B, then the identifier first passes by sensor A and then passes by sensor B. This means that the motor shaft may be rotating in one direction, e.g., clockwise. For example, if the rising edge of the input signal associated with sensor A lags the rising edge of the input signal associated with sensor B, then the identifier first passes by the sensor B and then passes by the sensor A. This means that the motor shaft may be rotating in the opposite direction, e.g., counter-clockwise.

At 808, an indication of a rotation direction is output. For example, the indication of rotation direction may be output to the downhole gauge which in turn sends the indication to the computer system. The indication may be that the motor shaft is rotating clockwise or counter-clockwise.

A rotation direction may be used to determine whether the motor is backspinning. If the motor is backspinning, then at 810 power is applied to the motor to produce artificial lift so as to avoid undue stress on the shaft and/or waste power. If the motor is not in backspin, then at 810 power is not applied to the motor to produce the artificial lift.

In one or more examples, the computer may control application of the power to the motor. In one or more examples, power may be applied to the motor even if it is in backspin. Power may be applied depending on backspin rotation speed. If the motor is in backspin and rotation speed is less than a threshold amount, power may be applied to the motor since any stress on the motor shaft and/or consumption of power to counteract any backspin may be minimal in comparison to producing artificial lift. Alternatively, if rotation speed is less than a threshold amount, power may be applied to the motor without having to determine whether the motor is in backspin since any stress on the motor shaft and/or consumption of power to counteract any backspin may be minimal in comparison to producing artificial lift. If the motor is in backspin but the speed is greater than a threshold amount, power may not be applied to the motor because undue stress will be applied to the motor shaft and/or the motor will consume excessive power to counteract the backspin.

Figure 9:
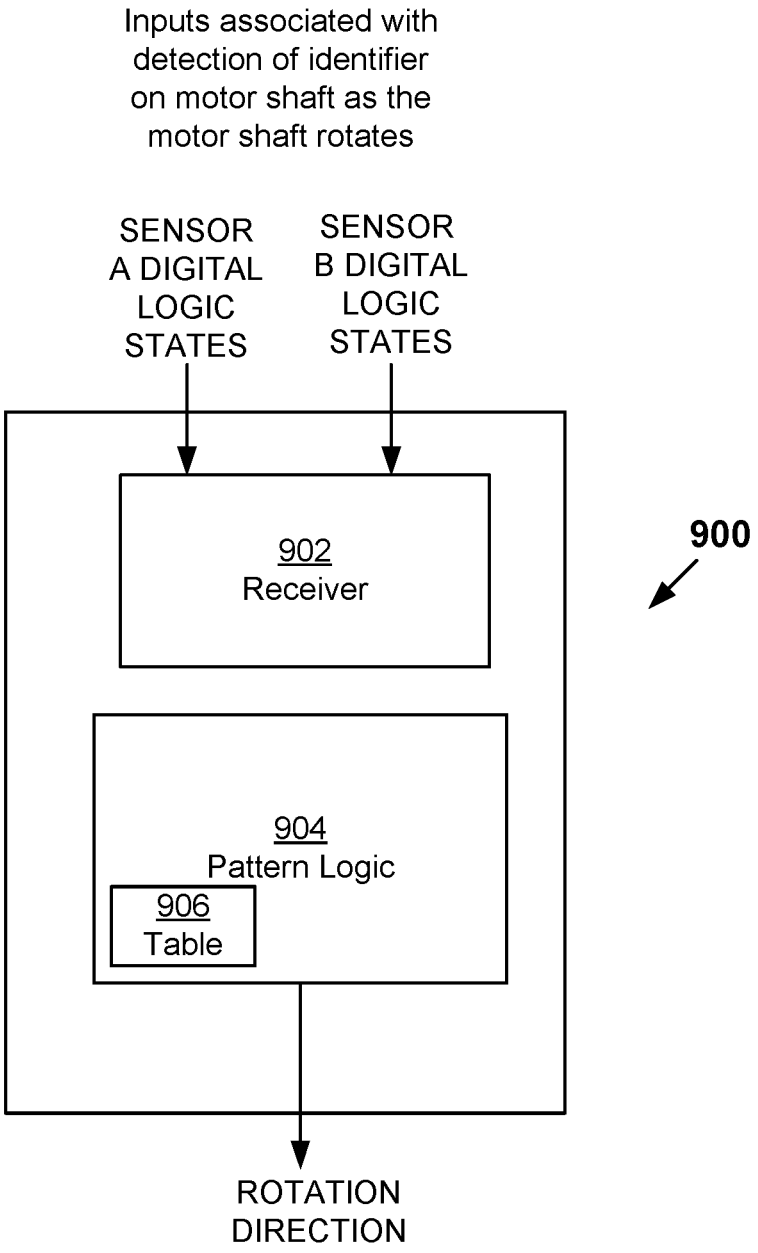
FIG. 9 is a block diagram of components for determining rotation direction of the motor shaft based on pattern matching.

FIG. 9 is a block diagram 900 of components for determining the rotation direction of the motor shaft based on pattern matching. The components may be part of the sensor circuitry, computer system, and/or combination of both the sensor circuitry and computer system. The block diagram 900 includes a receiver 902 and pattern logic 904. Elements of the block diagram 900 can be implemented in hardware, in software, or in combinations thereof. The input into the receiver 902 may be digital logic states associated with the sensors and the output of the pattern logic 904 may be the rotation direction of the motor shaft.

The receiver 902 may receive the digital logic states associated with sensors A and B. The sensor A digital logic states and sensor B digital logic states over a period of time may produce a pattern of logical 'high' and logical 'low' signals. This pattern may be unique depending on whether the motor shaft rotates in a clockwise direction or counter-clockwise direction. The pattern logic 904 may determine the rotation direction based on this pattern. Memory in the pattern logic 904 may store a table 906 such as shown in FIG. 3C or FIG. 4C. The pattern logic 904 may receive as an input sensor A digital logic states and sensor B digital logic states, compare sensor A digital logic states and sensor B digital logic states to the digital logic states in the table of FIG. 3C or FIG. 4C, and output a rotation direction.

For example, if sensor A digital logic state is a logical 'high' when sensor B digital logic state is a logical 'low' output, followed by sensor A digital logic state is logical 'high' when sensor B digital logic state is 'high', followed by sensor A digital logic state is logical 'low' when sensor B digital logic state is logical 'high', followed by sensor A digital logic state is logical 'low' when sensor B digital logic state is logical 'low', followed by sensor A digital logic state is logical 'high' output when sensor B digital logic state is a logical 'low', then the motor shaft may be rotating in a clockwise direction in accordance with FIG. 3C. The pattern logic 904 may output an indication of this direction. Alternatively, if sensor A digital logic state is a logical 'low' when sensor B digital logic state is a logical 'high', followed by sensor A is a logical 'high' when sensor B digital logic state is a logical 'high', followed by sensor A digital logic state is a logical 'high' when sensor B digital logic state is a logical 'low', followed by sensor A digital logic state is a logical 'low' when sensor B digital logic state is a logical 'low', followed by sensor A digital logic state is a logical 'low' when sensor B digital logic state is a logical 'high', then the motor shaft may be rotating in a counter-clockwise direction in accordance with FIG. 4C. The pattern logic 904 may output an indication of this direction. Other variations are also possible.

Figure 10:
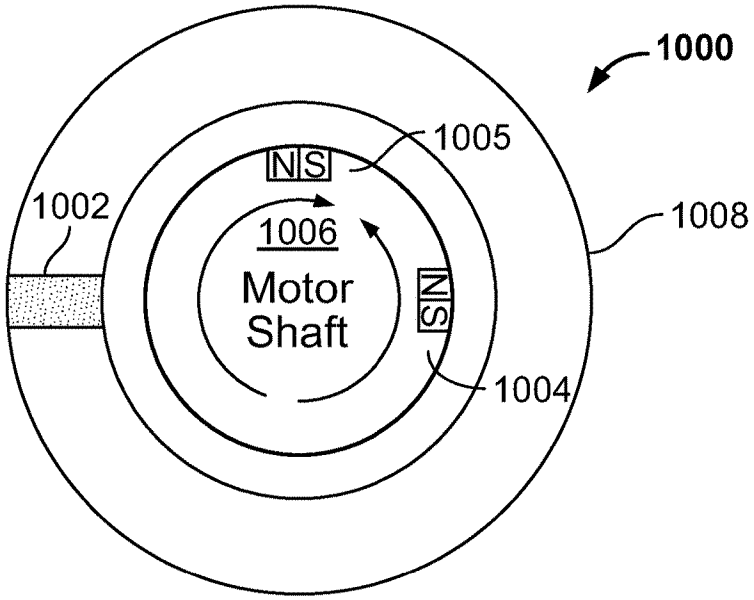
FIG. 10 is another example of the sensing apparatus.

FIG. 10 illustrates an example cross sectional view 1000 of sensor 1002, two or more identifiers 1004, 1005, and motor shaft 1006 of the ESP for determining a rotation speed and/or rotation direction of the motor shaft 1006. The sensor 1002 may be arranged proximate to the motor shaft 1006 on the collar 1008 or some other mounting location around the motor shaft 1006. The motor shaft 1006 may have two or more identifiers 1004, 1005 with unique properties. For example, if the identifiers are splines with magnetic properties, each spline may be magnetized by a different amount and/or have different sizes which results in magnetic fields of varying strengths. For example, a first spline may be magnetized at 20 milliTeslas while a second spline may be magnetized at 40 milliTeslas. The sensor 1002 may detect a presence and absence of the unique identifier as the motor shaft 1006 rotates. For example, the sensor 1002 detecting a magnetic field of 40 milliTeslas may indicate that the second spline is near the sensor 1002. As another example, the sensor 1002 detecting a magnetic field of 20 milliTeslas may indicate that the first spline is near the sensor 1002.

Figure 11:
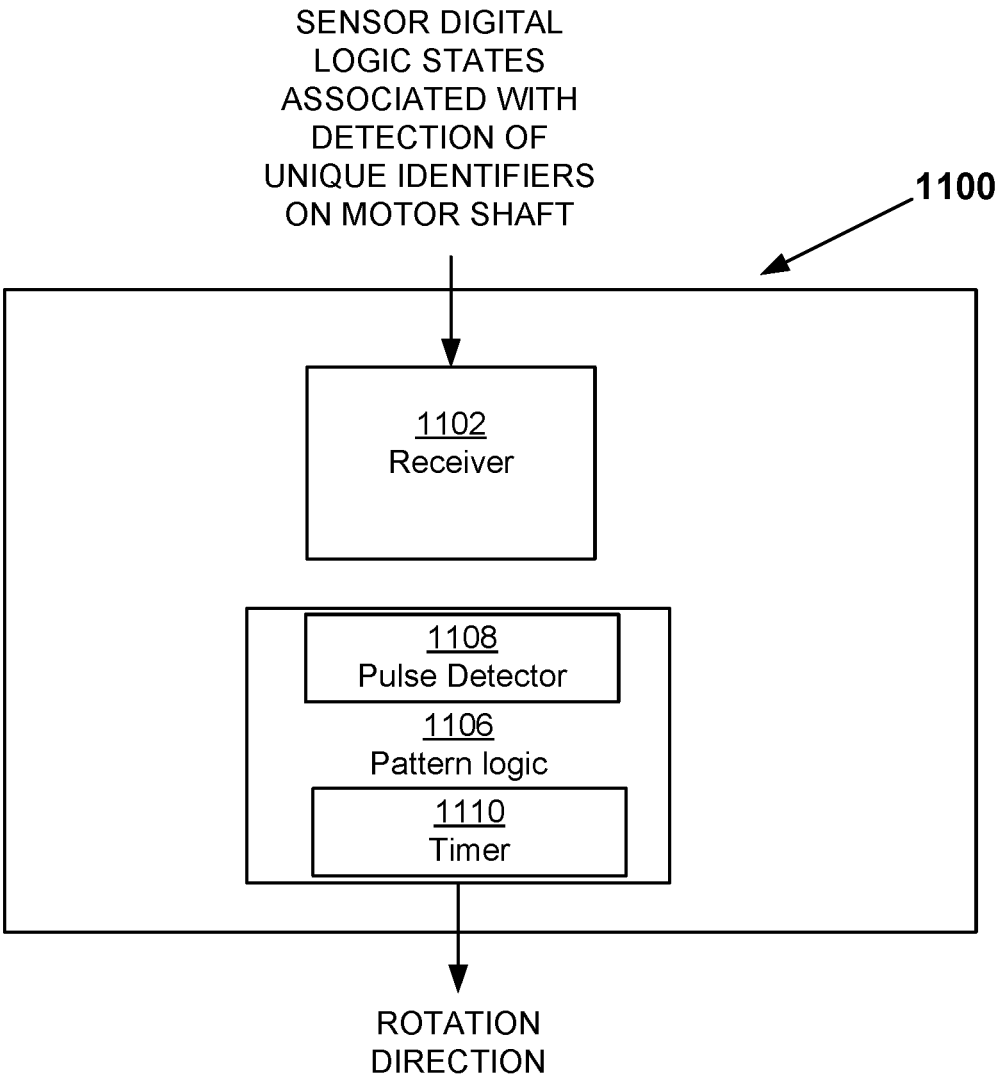
FIG. 11 is a block diagram of components associated with determining a rotation direction based on the motor shaft having two or more unique identifiers.

FIG. 11 is a block diagram 1100 of components associated with determining a rotation direction based on the one sensor and a motor shaft with two or more identifiers. The components include a receiver 1102 and pattern logic 1106. Elements of the block diagram 1100 can be implemented in hardware, in software, or in combinations thereof. The components may be part of the sensor circuitry, computer system, and/or combination of both the sensor circuitry and computer system. The receiver 1102 may receive sensor digital logic states associated with a sensor that detects unique identifiers and the pattern logic 1106 may output the rotation direction. The pattern logic 1106 may have a pulse detector 1108 and timer 1110 to facilitate determining the rotation direction.

Figure 12:
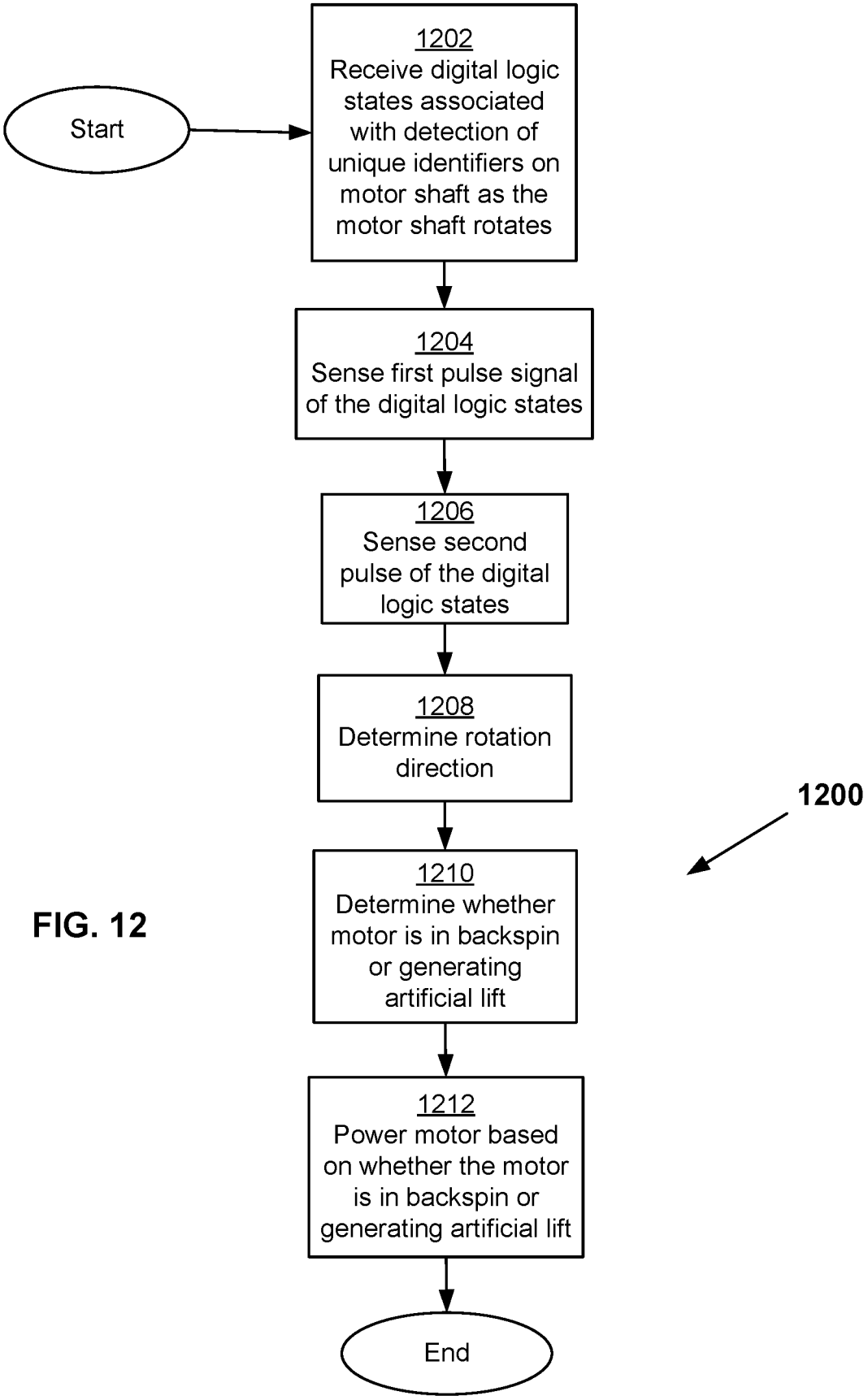
FIG. 12 is a flow chart of functions associated with determining the rotation direction based on the motor shaft having the two or more unique identifiers.

FIG. 12 is a flow chart of functions 1200 associated with determining the rotation direction based on the motor shaft having two or more unique identifiers.

At 1202, digital logic states are received by the receiver 1102 as the motor shaft rotates. The digital logic states are associated with detection of unique identifiers on the motor shaft.

Figure 13:
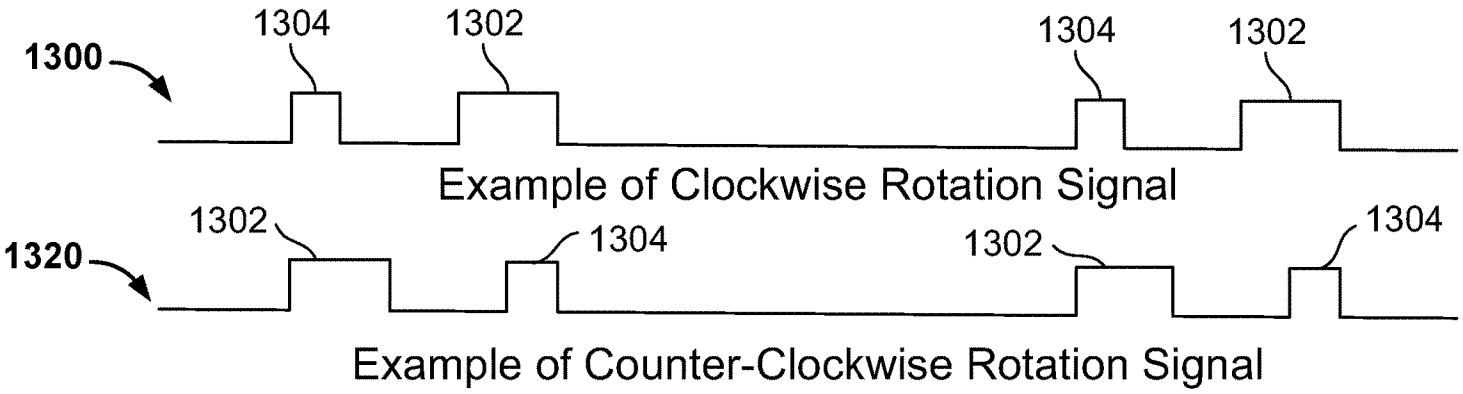
FIG. 13 illustrates example pulses.

FIG. 13 illustrates examples 1300, 1320 of the digital logic states. The digital logic states 1300, 1320 may include pulses 1302 and pulses 1304, one of which may be associated with one of the identifiers passing by the sensor and another identifier passing by the sensor. Since the magnetization of the identifiers are different, duration of the pulse may also be different. For example, a wide pulse 1302 may correspond to the identifier with higher magnetization passing by the sensor while a narrow pulse 1304 may correspond to the identifier with lower magnetization passing by the sensor.

The order by which the differently sized pulses are detected by the sensor indicate a rotation direction of the motor shaft 1006. In digital signal 1300, pulse 1304 may precede pulse 1302 indicating that the motor shaft 1006 is rotating in one direction, e.g., a clockwise direction. In digital signal 1320, pulse 1304 may follow pulse 1302 indicating that the motor shaft 1006 is rotating in an opposite direction, e.g., counter-clockwise direction.

At 1204, a first pulse of the digital logic states is sensed by the pulse detector 1108 of the pattern logic 1106. At 1206, the second pulse of the digital logic states is sensed by the pulse detector 1108 after sensing the first pulse by the pulse detector 1108 of the pattern logic 1106. For example, the pulse detector 1108 may sense a rising edge and falling edge of the first pulse and a rising edge and falling edge second pulse. At 1208, a rotation direction is determined by the pattern logic 1106. A timer 1110, also associated with pattern logic 1106, may measure a time between a rising edge and falling edge of a given pulse sensed by the pulse detector 1108 to determine a duration of a pulse. An order by which the pulses are detected indicates a rotation direction of the motor shaft 1006. For example, if a shorter pulse 1304 is detected before a longer pulse 1302, then the motor shaft 1106 may be rotating in a clockwise direction, as in 1300. Alternatively, if a longer pulse 1302 is detected before a shorter pulse 1304, then the motor shaft 1106 may be rotating in a counter-clockwise direction, as in 1320. If a duration of the first pulse is shorter 1304 than the second pulse 1302 as in 1300, then the motor shaft is rotating in one direction, e.g., indicating that artificial lift is produced. If a duration of the first pulse 1304 is shorter than the second longer pulse 1302 as in 1320, then the motor shaft 1106 may be rotating in the opposite direction, e.g., indicating that the motor shaft 1106 is in backspin.

At 1210, the rotation direction may be used to determine whether the motor is in backspin or producing artificial lift. If the motor is in backspin, then at 1212 power may not be applied to the motor to produce artificial lift to avoid undue stress on the shaft and/or to avoid the motor wasting power. If the motor is producing artificial lift, then at 1212 power may continue to be applied to the motor to produce artificial lift. Additionally, the rotation speed may be evaluated. If the speed is less than a threshold amount, power may still be applied to the motor since any stress on the shaft and/or power consumed to counteract the backspin may be minimal. If the motor is in backspin but the speed is greater than a threshold amount, then power may not be applied to the motor because undue stress will be applied to the shaft and/or the motor will consume excessive power to counteract the backspin.

Other variations are also possible for detecting a rotation direction and/or rotation speed. For example, more than two sensors could be used to detect a single identifier on the motor shaft. Alternatively, more than two identifiers may be used with a single sensor. Increasing one or more of the number of sensors and/or identifiers may increase robustness and/or accuracy of the resulting determination of rotation speed and/or rotation direction. In one or more examples, the sensor circuit may provide the output signals from the sensor to the computer system and the computer system may determine one or more of the rotation direction, rotation speed, and/or angular position of the motor shaft. In one or more examples, the ESP may determine one or more of the rotation direction, rotation speed, and/or angular position of the motor shaft itself and instruct the computer system to apply power or stop applying power to the ESP.

Figure 14:
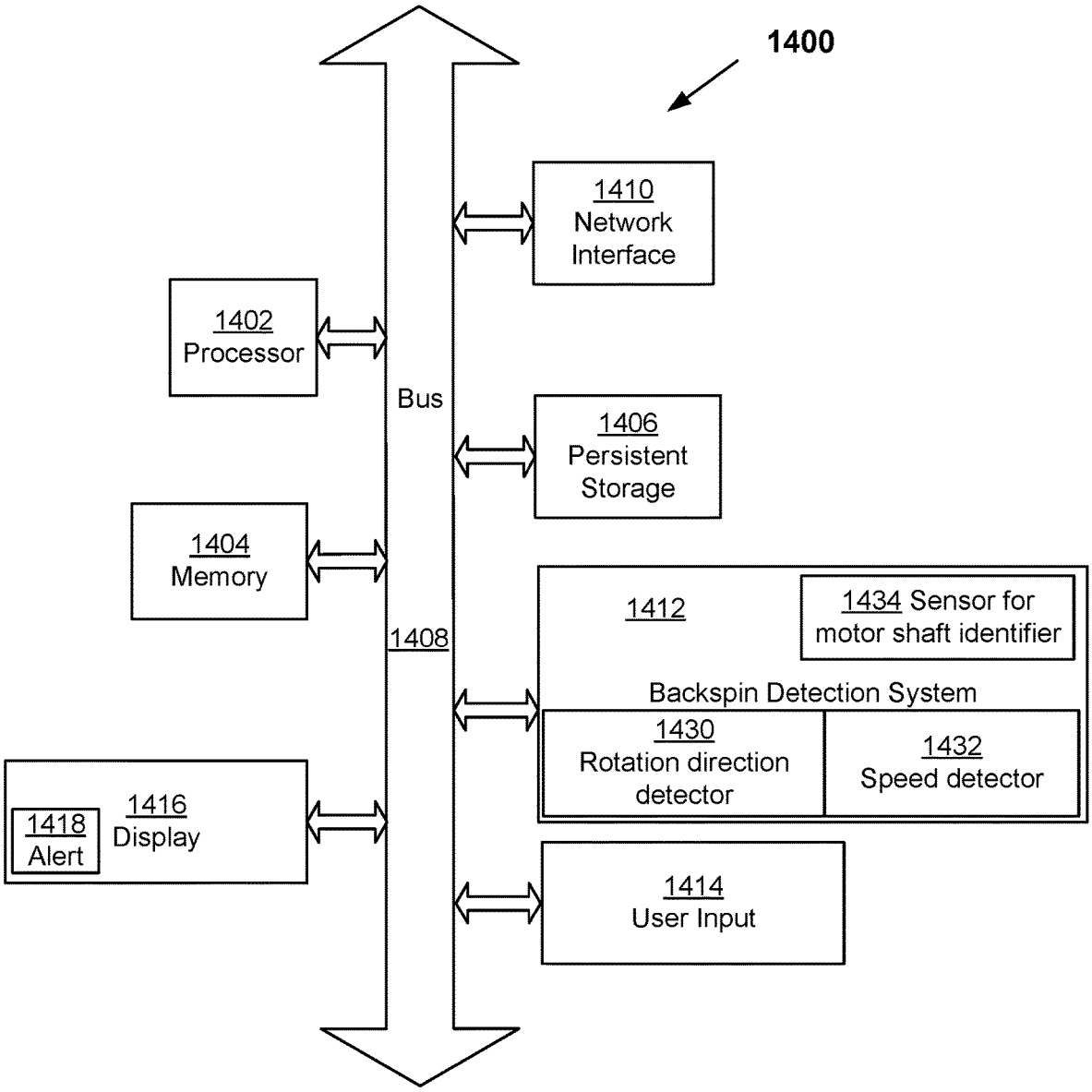
FIG. 14 is a block diagram of a system for determining rotation speed and rotation direction of an ESP.

FIG. 14 is a block diagram of a system 1400 for determining a rotational speed and/or direction of a motor in a downhole environment. The system 1400 may describe one or more of the computing system or sensor circuitry configured with hardware and/or software. The system 1400 may be located at a surface of a geological formation and/or downhole. In the case that the system 1400 is downhole, the system 1400 may be rugged, unobtrusive, can withstand the temperatures and pressures in situ at the wellbore.

The system 1400 includes a processor 1402 (possibly including multiple processors, multiple cores, multiple nodes, and/or implementing multi-threading, etc.). The system 1400 includes memory 1404. The memory 1404 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of non-transitory machine-readable and/or computer-readable media for storing computer instructions, program code, and/or software executable by the processor 1402.

The system 1400 may also include a persistent data storage 1406. The persistent storage 1406 can be a hard disk drive, such as magnetic storage device. The computer device also includes a bus 1408 (e.g., PCI, ISA, PCI-Express) and/or network interface 1410. The persistent storage 1406 may store sensor measurements associated with sensing identifiers on a motor shaft of a motor. The sensor measurements may be received via the network interface 1410 from the sensor and stored in the persistent storage 1406. The system 1400 may have a backspin detection system 1412 with sensor 1434 for motor shaft identifier, rotation direction detector 1430 and speed detector 1432 for determining one or more of an angular position, rotation speed and/or direction of a motor shaft associated with an ESP in accordance with the methods and block diagrams described above. The backspin detection system 1412 may also be arranged to control pumping of the ESP based on whether the ESP is in backspin or not.

Further, the system 1400 may comprise a user input 1414 and display 1416. The user input 1414 may be a keyboard, mouse, and/or touch screen, among other examples, for receiving input to control power to the motor. The display 1416 may comprise a computer screen or other visual device that shows one or more of a rotation speed and/or rotation direction of a motor, for example. Additionally, the display 1416 may convey alerts 1418. The backspin detection system 1412 may generate the alerts 1418 indicating one or more of a rotation speed, rotation direction of a motor shaft, and/or whether the motor shaft is in backspin.

The system 1400 may implement any one of the previously described functionalities partially (or entirely) in hardware and/or in software (e.g., computer code, program code, program instructions) stored on a non-transitory machine-readable medium/media. In one or more examples, the software is executed by the processor 1402. Further, realizations can include fewer or additional components not illustrated in FIG. 14 (e.g., video cards, audio cards, additional network interfaces, peripheral devices, etc.). The processor 1402 and the memory 1404 are coupled to the bus 1408. Although illustrated as being coupled to the bus 1408, the memory 1404 can be coupled to the processor 1402.

The flowcharts are provided to aid in understanding the illustrations and are not to be interpreted to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit", "module", or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine readable medium may be a machine-readable signal medium or a machine-readable storage medium. A machine-readable storage medium may be, for example, but not limited to, a system, apparatus, or device, that employs any one of, or combination of, electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by, or in connection with, an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical-fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results, and or, accepting input from another machine.

The program code/instructions may also be stored in a machine-readable medium that can direct a machine to function in a particular manner, such that the instructions stored in the machine-readable medium produce an article of manufacture including instructions that implement the function/act specified in the flowchart and/or block diagram block or blocks.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1

A method comprising: sensing, by one or more sensors mounted proximate to a motor shaft of a motor, one or more identifiers located on the motor shaft, the motor being associated with an electrically submersible pump (ESP) positioned in a wellbore of a geological formation; determining one or more of a rotation direction and rotation speed of the motor shaft based on the sensing of the one or more identifiers; and powering the motor to pump fluid from a reservoir in the geological formation to a surface of the geological formation based on the one or more of the rotation direction and rotation speed of the motor shaft.

Embodiment 2

The method of Embodiment 1, wherein the one or more identifiers are magnetic splines on the motor shaft.

Embodiment 3

The method of Embodiment 1 or 2, wherein the one or more identifiers is a single identifier and the one or more sensors is a first sensor and a second sensor; wherein the first sensor outputs a first signal based on sensing of the single identifier and the second sensor outputs a second signal based on sensing of the single identifier, wherein determining the rotation direction comprises converting the first and second signal into respective digital logic states, and comparing a pattern of the respective digital logic states to a pattern that indicates rotation direction.

Embodiment 4

The method of any of Embodiments 1-3, wherein a given sensor outputs an analog signal that indicates a given identifier being sensed as the motor shaft rotates; and wherein determining the rotation speed comprises determining a frequency of the analog signal that indicates rotation speed.

Embodiment 5

The method of any of Embodiments 1-4, wherein powering the motor to pump fluid comprises powering the motor only when the rotation speed is less than a threshold amount.

Embodiment 6

The method of any of Embodiments 1-5, wherein the rotation direction indicates whether the ESP is in backspin; and wherein powering the motor to pump fluid comprises powering the motor when the ESP is not in backspin.

Embodiment 7

The method of any of Embodiments 1-6, wherein the rotation direction indicates whether the ESP is in backspin; and wherein powering the motor to pump fluid comprises powering the motor when the ESP is in backspin and the rotation speed is less than a threshold amount.

Embodiment 8

The method of any of Embodiments 1-7, wherein the one or more identifiers comprises a first identifier and a second identifier having different magnetizations, and wherein sensing the one or more identifiers comprises detecting a first pulse with a first size and a second pulse with a second size; and wherein determining the rotation direction of the rotating motor shaft comprises determining relative order of receipt of the two pulses.

Embodiment 9

An electric submersible pump (ESP) comprising: a motor base;

a motor coupled to the motor base; a rotating motor shaft of the motor, wherein the rotating motor shaft has one or more identifiers; a collar positioned around the rotating motor shaft; a one or more of sensors positioned on the collar to sense the one or more identifiers; computer instructions stored in memory and executable by a processor to: receive from the one or more sensors an indication that the one or more motor shaft identifiers are sensed as the motor shaft rotates; determine one or more of a rotation direction and rotation speed of the rotating motor shaft based on the indication that the one or more motor shaft identifiers are sensed; and control power applied to the motor to pump fluid from a reservoir in a geological formation to a surface of the geological formation based on the one or more of the rotation direction and rotation speed of the rotating motor shaft.

Embodiment 10

The electric submersible pump of Embodiment 9, wherein the sensor senses magnetic fields or senses changes in the magnetic fields associated with the one or more motor shaft identifiers.

Embodiment 11

The electric submersible pump of Embodiment 9 or 10, wherein the motor shaft identifier is a slot on the rotating motor shaft having magnetic properties.

Embodiment 12

The electric submersible pump of any of Embodiments 9-11, wherein the rotating motor shaft has two motor shaft identifiers with different magnetic properties.

Embodiment 13

The electric submersible pump of any of Embodiments 9-12, wherein the sensor positioned comprises two sensors positioned at different azimuthal positions around the motor shaft.

Embodiment 14

The electrical submersible pump of any of Embodiments 9-13, wherein the rotation direction indicates whether the ESP is in backspin; and wherein the computer instructions to control power to the motor to pump fluid comprises computer instructions to power the motor when the ESP is not in backspin.

Embodiment 15

The electrical submersible pump of any of Embodiments 9-14, wherein the one or more motor shaft identifiers is a single identifier and the one or more sensors is a first sensor and a second sensor; wherein the first sensor outputs a first signal when the single identifier is sensed and the second sensor outputs a second signal when the single identifier is sensed; and wherein the computer instructions to determine one or more of a rotation direction and rotation speed comprises computer instructions to convert a first signal and a second signal into respective digital logic states, and to compare a pattern of the respective digital logic states to a pattern that indicates rotation direction.

Embodiment 16

The electrical submersible pump of any of Embodiments 9-15, wherein the one or more motor shaft identifiers comprises a first identifier and a second identifier having differing magnetizations, and wherein the computer instructions receive from the sensor the indication of the one or more identifiers comprises computer instructions to receive a first pulse with a first size and a second pulse with a second size; and wherein the computer instructions determine the rotation direction of the rotating motor shaft comprises computer instructions to determine the relative order of receiving the two pulses.

Embodiment 17

A system comprising: a computer system located at a surface of a geological formation; an electrical submersible pump (ESP) positioned in a wellbore of the geological formation, the ESP having computer instructions stored in memory and executable by a processor to: receive from a sensor an indication of the one or more identifiers located on a rotating motor shaft of a motor, wherein the sensor is mounted on a collar around the rotating motor shaft of the motor; determine one or more of a rotation direction, and rotation speed of the rotating motor shaft based on the indication of the one or more identifiers; and transmit the one or more of a rotation direction and rotation speed of the rotating motor shaft to the computer system; the computer system having computer instructions stored in memory and executable by a processor to: receive the one or more of a rotation direction and rotation speed from the ESP; and cause the motor to pump fluid from a reservoir to a surface of the geological formation based on the one or more of the rotation direction and rotation speed of the rotating motor shaft.

Embodiment 18

The system of Embodiment 17, wherein the rotation direction indicates whether the ESP is in backspin; and wherein the program instructions to cause the motor to pump fluid comprises computer instructions to control application of power to the motor when the ESP is not in backspin.

Embodiment 19

The system of Embodiment 17 or 18, wherein the rotation direction indicates whether the ESP is in backspin; and wherein the program instructions to cause the motor to pump fluid comprises program instructions to control application of power to the motor when the ESP is in backspin and the rotation speed is less than a threshold amount.

Embodiment 20

The system of any of Embodiments 17-19, wherein the one or more identifiers is a spline on the rotating motor shaft having magnetic properties.

What is claimed is:

1. A method comprising:

sensing, by one or more sensors mounted proximate to a motor shaft of a motor, one or more identifiers located on the motor shaft, the motor being associated with an electrically submersible pump (ESP) positioned in a wellbore of a geological formation;

determining a rotation direction and a rotation speed of the motor shaft based on the sensing of the one or more identifiers wherein the rotation direction indicates whether the ESP is in backspin; and powering the motor to pump fluid from a reservoir in the geological formation to a surface of the geological formation based on the one or more of the rotation direction and rotation speed of the motor shaft, wherein powering the motor to pump fluid comprises powering the motor when the ESP is in backspin and the rotation speed is less than a threshold amount.

2. The method of claim 1, wherein the one or more identifiers are magnetic splines on the motor shaft.

3. The method of claim 1, wherein the one or more identifiers is a single identifier and the one or more sensors is a first sensor and a second sensor; wherein the first sensor outputs a first signal based on sensing of the single identifier and the second sensor outputs a second signal based on sensing of the single identifier, wherein determining the rotation direction comprises converting the first and second signal into respective digital logic states, and comparing a pattern of the respective digital logic states to a pattern that indicates rotation direction.

4. The method of claim 1, wherein a given sensor outputs an analog signal that indicates a given identifier being sensed as the motor shaft rotates; and wherein determining the rotation speed comprises determining a frequency of the analog signal that indicates rotation speed.

5. The method of claim 1, wherein powering the motor to pump fluid comprises powering the motor only when the rotation speed is less than a threshold amount.

6. The method of claim 1, wherein the rotation direction indicates whether the ESP is in backspin; and wherein powering the motor to pump fluid comprises powering the motor when the ESP is not in backspin.

7. The method of claim 1, wherein the one or more identifiers comprises a first identifier and a second identifier having different magnetizations, and wherein sensing the one or more identifiers comprises detecting a first pulse with a first size and a second pulse with a second size; and wherein determining the rotation direction of the rotating motor shaft comprises determining relative order of receipt of the two pulses.

8. An electric submersible pump (ESP) comprising:

a motor base; a motor coupled to the motor base;

a rotating motor shaft of the motor, wherein the rotating motor shaft has one or more identifiers;

a collar positioned around the rotating motor shaft; a one or more of sensors positioned on the collar to sense the one or more identifiers;

computer instructions stored in memory and executable by a processor to:

receive from the one or more sensors an indication that the one or more motor shaft identifiers are sensed as the motor shaft rotates;

determine one or more of a rotation direction and rotation speed of the rotating motor shaft based on the indication that the one or more motor shaft identifiers are sensed;

and control power applied to the motor to pump fluid from a reservoir in a geological formation to a surface of the geological formation based on the one or more of the rotation direction and rotation speed of the rotating motor shaft.

9. The electric submersible pump of claim 8, wherein the sensor senses magnetic fields or senses changes in the magnetic fields associated with the one or more motor shaft identifiers.

10. The electric submersible pump of claim 8, wherein the motor shaft identifier is a slot on the rotating motor shaft having magnetic properties.

11. The electric submersible pump of claim 8, wherein the rotating motor shaft has two motor shaft identifiers with different magnetic properties.

12. The electric submersible pump of claim 8, wherein the sensor positioned comprises two sensors positioned at different azimuthal positions around the motor shaft.

13. The electrical submersible pump of claim 8, wherein the rotation direction indicates whether the ESP is in backspin; and wherein the computer instructions to control power to the motor to pump fluid comprises computer instructions to power the motor when the ESP is not in backspin.

14. The electrical submersible pump of claim 8, wherein the one or more motor shaft identifiers is a single identifier and the one or more sensors is a first sensor and a second sensor;

wherein the first sensor outputs a first signal when the single identifier is sensed and the second sensor outputs a second signal when the single identifier is sensed; and wherein the computer instructions to determine one or more of a rotation direction and rotation speed comprises computer instructions to convert a first signal and a second signal into respective digital logic states, and to compare a pattern of the respective digital logic states to a pattern that indicates rotation direction.

15. The electrical submersible pump of claim 8, wherein the one or more motor shaft identifiers comprises a first identifier and a second identifier having differing magnetizations, and wherein the computer instructions receive from the sensor the indication of the one or more identifiers comprises computer instructions to receive a first pulse with a first size and a second pulse with a second size; and wherein the computer instructions determine the rotation direction of the rotating motor shaft comprises computer instructions to determine the relative order of receiving the two pulses.

16. A system comprising:

a computer system located at a surface of a geological formation;

an electrical submersible pump (ESP) positioned in a wellbore of the geological formation, the ESP having computer instructions stored in memory and executable by a processor to:

receive from a sensor an indication of the one or more identifiers located on a rotating motor shaft of a motor, wherein the sensor is mounted on a collar around the rotating motor shaft of the motor;

determine one or more of a rotation direction and rotation speed of the rotating motor shaft based on the indication of the one or more identifiers; and transmit the one or more of a rotation direction and rotation speed of the rotating motor shaft to the computer system;

the computer system having computer instructions stored in memory and executable by a processor to:

receive the one or more of a rotation direction and rotation speed from the ESP; and cause the motor to pump fluid from a reservoir to a surface of the geological formation based on the one or more of the rotation direction and rotation speed of the rotating motor shaft.

17. The system of claim 16, wherein the rotation direction indicates whether the ESP is in backspin; and wherein the program instructions to cause the motor to pump fluid comprises computer instructions to control application of power to the motor when the ESP is not in backspin.

18. The system of claim 16, wherein the rotation direction indicates whether the ESP is in backspin; and wherein the program instructions to cause the motor to pump fluid comprises program instructions to control application of power to the motor when the ESP is in backspin and the rotation speed is less than a threshold amount.

19. The system of claim 16, wherein the one or more identifiers is a spline on the rotating motor shaft having magnetic properties.

* * * * *